US009037355B2

(12) United States Patent
Scheer

(10) Patent No.: US 9,037,355 B2
(45) Date of Patent: May 19, 2015

(54) CONTROL ASSEMBLY FOR AUXILIARY HYDRAULICS

(75) Inventor: Glenn O. Scheer, Durango, IA (US)

(73) Assignee: Deere & Company, Moline, IL (US)

( * ) Notice: Subject to any disclaimer, the term of this patent is extended or adjusted under 35 U.S.C. 154(b) by 1671 days.

(21) Appl. No.: 11/934,855

(22) Filed: Nov. 5, 2007

(65) Prior Publication Data

US 2009/0118911 A1 May 7, 2009

(51) Int. Cl.

| | |
|---|---|
| ***E02F 9/20*** | (2006.01) |
| ***G05G 1/06*** | (2006.01) |
| *G05G 9/047* | (2006.01) |

(52) U.S. Cl.

CPC ..... *E02F 9/2004* (2013.01); *G05G 1/06* (2013.01); *G05G 2009/04774* (2013.01)

(58) Field of Classification Search

USPC ..... 701/36, 49, 50, 51, 55, 62; 700/275; 37/234, 414; 414/744.1, 744.2; 60/327; 74/469, 479.01, 483, 490.01, 491, 492, 74/495, 520, 559

See application file for complete search history.

(56) References Cited

U.S. PATENT DOCUMENTS

| | | | | |
|---|---|---|---|---|
| 3,296,791 | A | 1/1967 | Richard et al. | 60/19 |
| 3,649,817 | A * | 3/1972 | Keller et al. | 708/531 |
| 3,977,301 | A | 8/1976 | Kroth et al. | 91/412 |
| 4,472,676 | A * | 9/1984 | Eichmann et al. | 324/509 |
| 4,484,069 | A * | 11/1984 | Brenholdt | 356/3.02 |
| 4,495,578 | A * | 1/1985 | Sibley et al. | 701/20 |
| 4,524,451 | A * | 6/1985 | Watanabe | 381/1 |
| 4,546,847 | A * | 10/1985 | Abels | 180/307 |
| 4,949,805 | A | 8/1990 | Mather et al. | 180/333 |
| 5,428,439 | A * | 6/1995 | Parker et al. | 356/5.01 |
| 5,469,694 | A * | 11/1995 | Panousheck et al. | 56/10.2 E |
| 5,537,818 | A | 7/1996 | Hosseini et al. | 60/327 |
| 5,590,731 | A * | 1/1997 | Jacobson | 180/53.4 |
| 6,135,230 | A | 10/2000 | Schenck et al. | 180/273 |
| 6,186,260 | B1 | 2/2001 | Schenck et al. | 180/273 |
| 6,202,014 | B1 | 3/2001 | Brandt et al. | 701/50 |
| 6,208,107 | B1 * | 3/2001 | Maske et al. | 318/685 |
| 6,260,357 | B1 | 7/2001 | Goodfellow et al. | 60/470 |
| 6,295,486 | B1 * | 9/2001 | Denz | 701/1 |
| 6,425,729 | B1 | 7/2002 | Coutant | 414/685 |
| 6,498,973 | B2 | 12/2002 | Dix et al. | 701/50 |
| 6,502,500 | B2 | 1/2003 | Yoshino | 91/454 |
| 6,520,593 | B2 | 2/2003 | Dvorak et al. | 299/39.5 |
| 6,542,789 | B2 | 4/2003 | Ufheil | 700/275 |
| 6,571,902 | B2 * | 6/2003 | Heyne et al. | 180/321 |
| 6,681,551 | B1 * | 1/2004 | Sheidler et al. | 56/10.2 G |
| 6,871,483 | B1 * | 3/2005 | Panoushek | 56/10.2 E |

(Continued)

FOREIGN PATENT DOCUMENTS

| | | |
|---|---|---|
| WO | 0713614 | 6/2007 |

OTHER PUBLICATIONS

Caterpillar; 252B/262B/268B Skid Steer Loaders; 2005; p. 4.

*Primary Examiner* — Nicholas Kiswanto

(74) *Attorney, Agent, or Firm* — Quarles & Brady LLP

(57) ABSTRACT

A ground engaging vehicle including a tool having a moving member and a control system controlling a speed of the moving member. The control system includes an adjustable proportional control and a triggering control. The adjustable proportional control creates a signal to thereby select a direction and a speed of the moving member. The triggering control setting the direction and/or the speed dependent upon the signal resulting in a set direction and a set speed, the triggering control subsequently setting the speed to zero.

14 Claims, 7 Drawing Sheets

(56) References Cited

U.S. PATENT DOCUMENTS

| | | | | |
|---|---|---|---|---|
| 7,599,775 | B2 * | 10/2009 | Furuno | 701/50 |
| 7,729,835 | B2 * | 6/2010 | Morris et al. | 701/50 |
| 2001/0016794 | A1 * | 8/2001 | Falck et al. | 701/50 |
| 2002/0173932 | A1 * | 11/2002 | Yoon | 702/151 |
| 2005/0034915 | A1 * | 2/2005 | Kumazawa | 180/331 |
| 2005/0085929 | A1 * | 4/2005 | Koch et al. | 700/83 |
| 2005/0283295 | A1 | 12/2005 | Normann | 701/50 |
| 2006/0089773 | A1 * | 4/2006 | Hendron | 701/50 |
| 2006/0129280 | A1 | 6/2006 | Thomas et al. | 700/275 |
| 2006/0237958 | A1 * | 10/2006 | Dix et al. | 280/764.1 |

* cited by examiner

CONTROL ASSEMBLY FOR AUXILIARY HYDRAULICS

BACKGROUND OF THE INVENTION

1. Field of the Invention

The present invention relates to a control system for hydraulics, and, more particularly, to a control system for auxiliary hydraulics of a ground engaging machine.

2. Description of the Related Art

Work machines, such as backhoes, skid loaders and other similar equipment typically have an operator station connected to a frame that is attached to movable elements that are hydraulically controlled. The moveable portions of the machine may include arms that are connected to tools, such as buckets, post hole diggers, rotating brushes, scraper blades, and/or any kind of assembly that is power driven or positioned by the hydraulic system of the work machine.

Work machines commonly include an engine which drives a hydraulic pump that provides power to various components of the work machine. Attachments to the work machine typically include their own hydraulic motor for driving the attachment, yet are dependent upon the hydraulic system of the work machine to provide the pressurized fluid in the hydraulic system for driving the hydraulic motor of the attachment. Control systems of the work machine are often configured to provide operational control for the auxiliary hydraulic motors of the auxiliary systems.

It is known to provide control levers in the form of joysticks with the joysticks including additional switches, triggers and other input devices for controlling electrical and/or hydraulic systems on the work machine.

What is needed in the art is an improved hydraulic control system for controlling auxiliary systems attached to the work machine.

SUMMARY OF THE INVENTION

The present invention provides a control system for auxiliary hydraulic systems attached to a ground engaging vehicle.

The invention in one form is directed to a ground engaging vehicle including a tool having a moving member and a control system controlling a speed of the moving member. The control system includes an adjustable proportional control and a triggering control. The adjustable proportional control creates a signal to thereby select a direction and a speed of the moving member. The triggering control setting the direction and/or the speed dependent upon the signal resulting in a set direction and a set speed, the triggering control subsequently setting the speed to zero.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
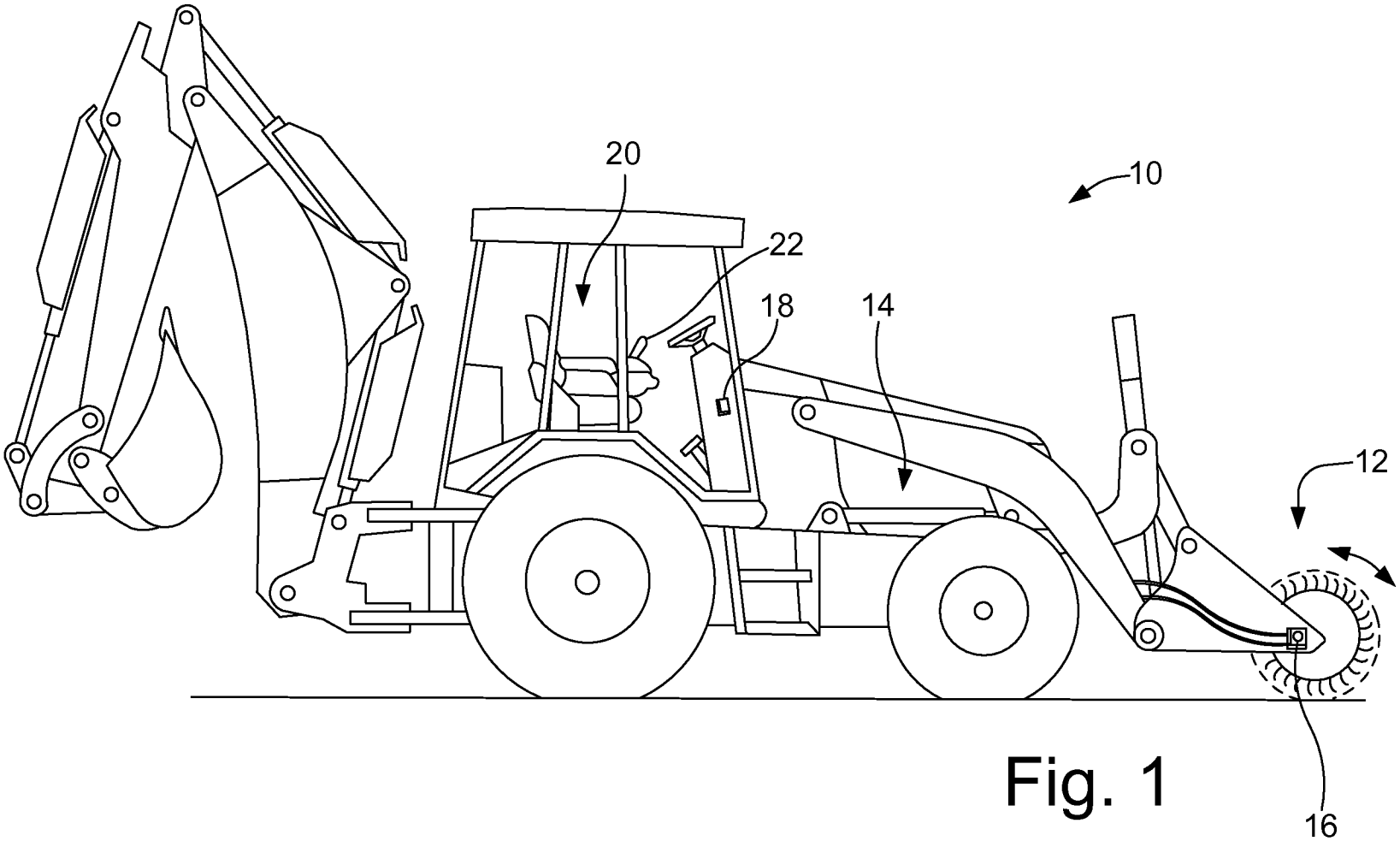
FIG. 1 is a partially schematic side view of a work machine including an embodiment of an operator control system according to the present invention.

Referring now to the drawings, and more particularly to FIG. 1, there is shown a ground engaging vehicle 10 configured, for example, as a backhoe with an auxiliary attachment attached thereto. It is understood that ground engaging vehicle 10 can be any type of work machine, including, but not limited to, machines utilized in the construction, forestry and agricultural industries. Ground engaging vehicle 10 includes a moving member 12, illustrated herein as a rotating brush 12 that is driven by a hydraulic system 14 of vehicle 10. Rotating brush 12 includes an auxiliary hydraulic system 16 that is interconnected with hydraulic system 14. Auxiliary hydraulic system 16 includes a motor that is driven by hydraulic system 14 from which pressurized fluid is routed. Ground engaging vehicle 10 additionally includes a control system 18 and an operator seating system 20. Operator seating system 20 includes control devices that interact with control system 18 to provide electrical and hydraulic controls to ground engaging vehicle 10. In addition to providing control to the elements of ground engaging vehicle 10, control system 18 additionally controls auxiliary hydraulic system 16 by controlling the fluid flow and pressure to the hydraulic motor of auxiliary hydraulic system 16.

Figure 2:
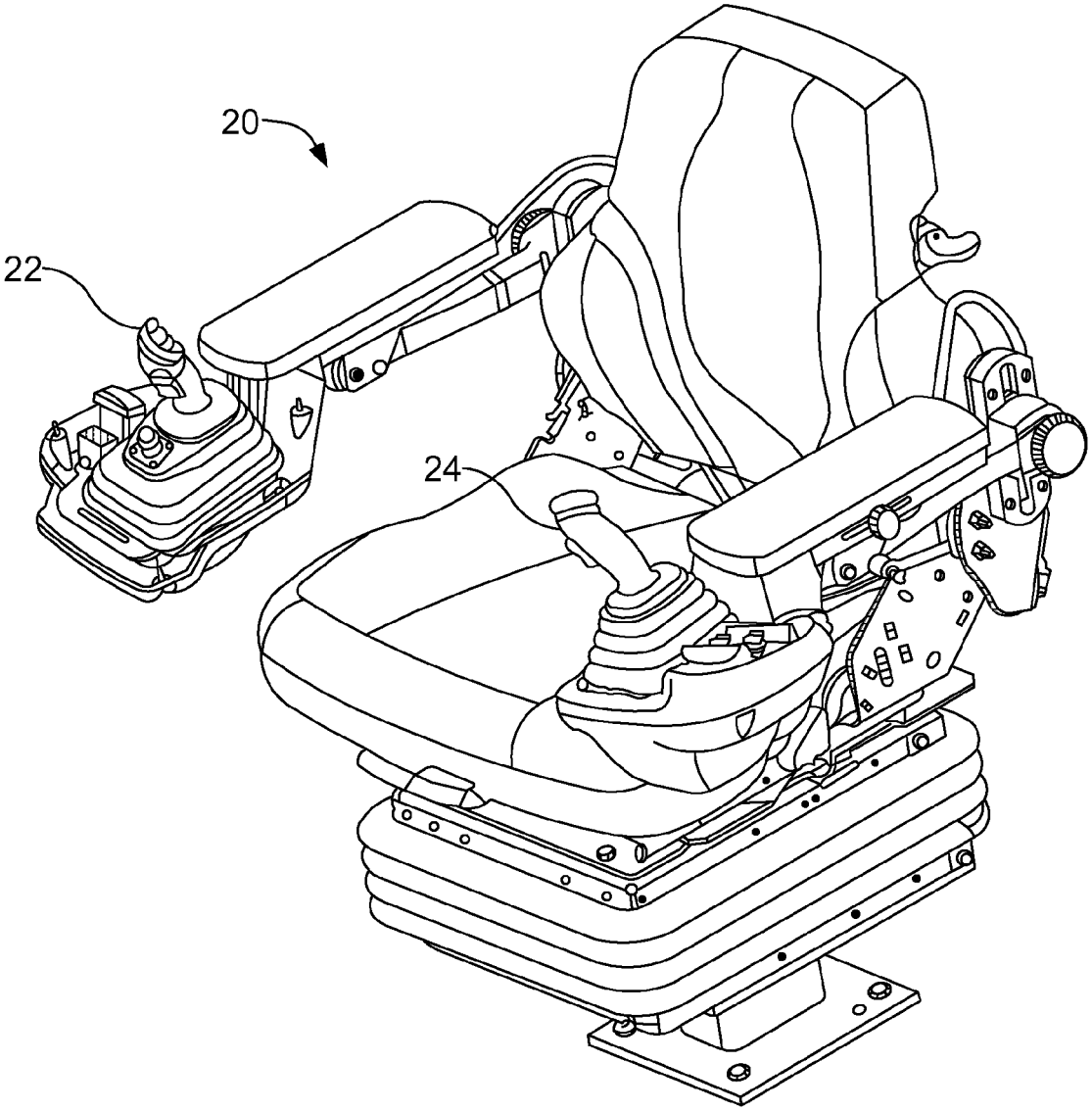
FIG. 2 is a perspective view of an operator control system used in the work machine of FIG. 1.
Figure 3:
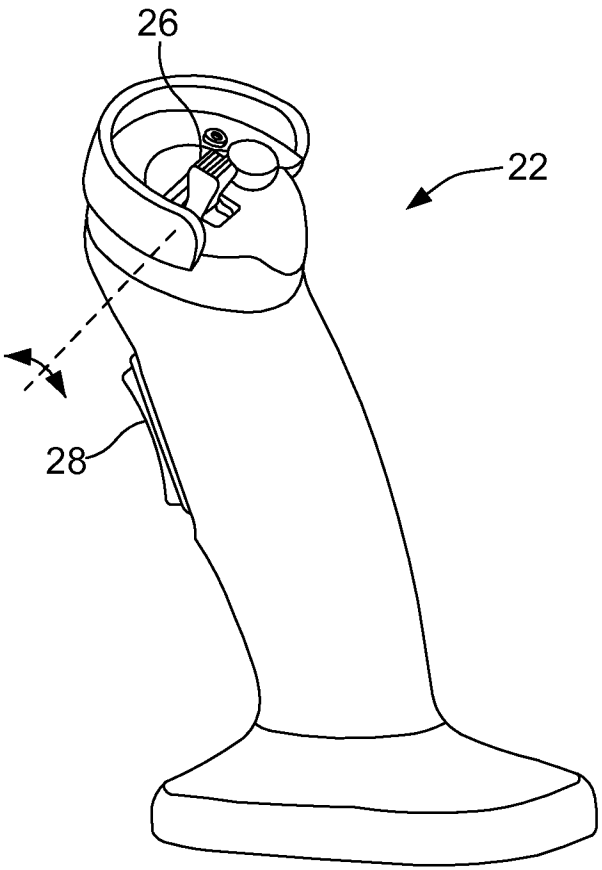
FIG. 3 is a perspective view of one embodiment of an operator input assembly used in the operator control system of FIG. 2.
Figure 4:
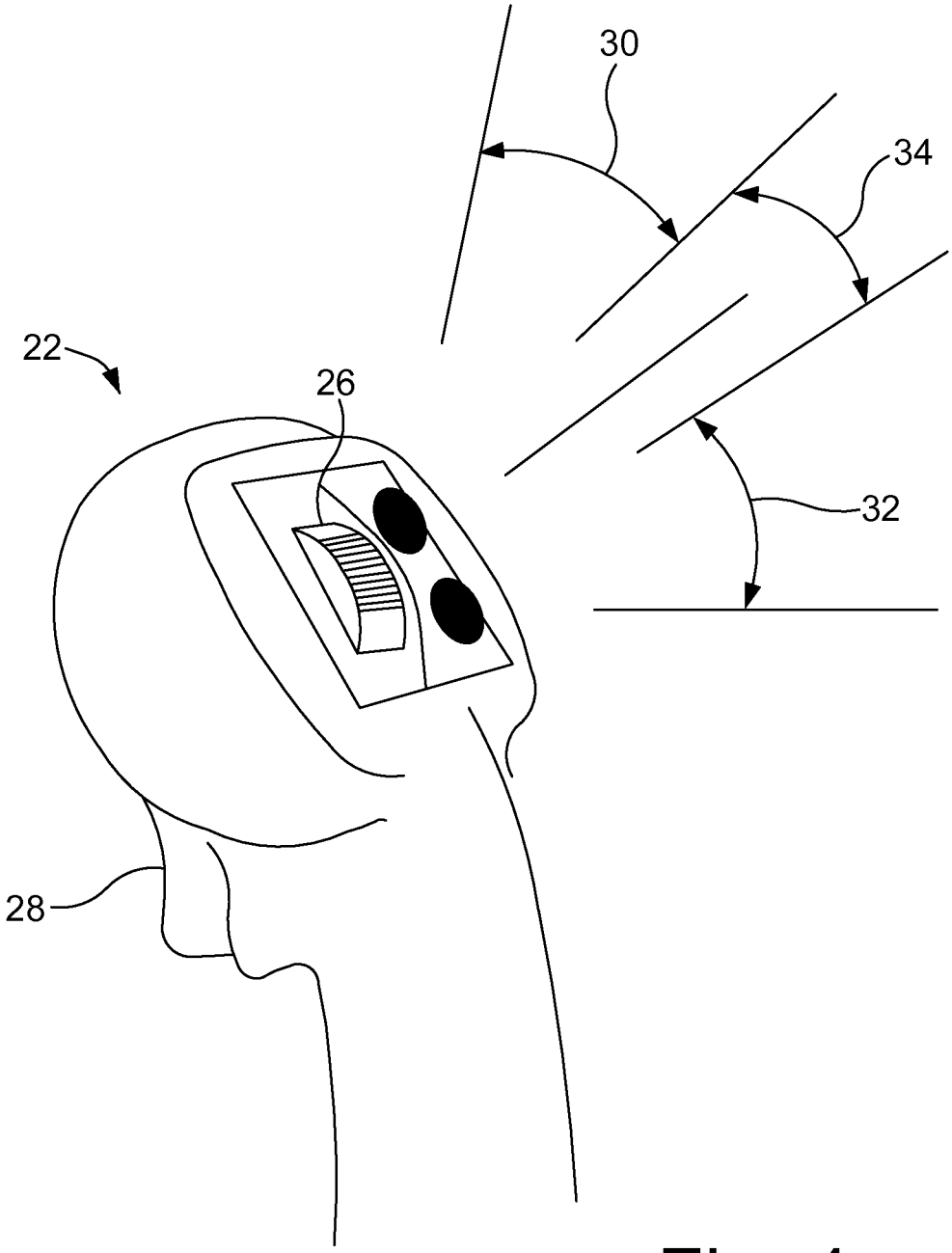
FIG. 4 is another embodiment of an operator input assembly of the present invention used in the operator control system of FIG. 2.

Now, additionally referring to FIGS. 2-4 there is shown operating seating system 20 and includes a first control joystick 22 and a second control joystick 24. The elements contained on one joystick 22 and/or 24 may be located on either joystick and the functions described hereafter will, for the sake of clarity and ease of understanding, be illustrated as existing on joystick 22, although it is merely done for convenience and it is to be understood that the elements described may exist in combination between joysticks 22 and 24. Joystick 22 includes a proportional controller 26 and a trigger 28. Proportional control 26 can be in the form of a roller 26 that provides a proportional output based on its relative position. Trigger 28 can be thought of as an on/off switch that provides a triggering control and is energized when depressed and not energized when released. Proportional control 26 includes an extend range 30, a retract range 32 and a neutral range 34. Extend range 30 can also be understood to be a forward direction 30 and retract range 32 can be understood to be a reverse range 32. This concept can be easily understood by considering the type of auxiliary attachment that may be connected to ground engaging vehicle 10. For example, brush 12 rotates in either a forward or reverse direction hence reference to a forward range 30 and a reverse range 32 makes sense in this illustration. Alternatively, if moving member 12 had a linear motion portion it would be considered an extend range 30 and a retract range 32 that would be applicable thereto. For ease of illustration, the ranges for proportional control 26 will be referred to as forward range 30, reverse range 32 and neutral range 34.

When proportional control 26 is released it is biased to return to a neutral position. A signal is produced by proportional control 26 that is analogous to the position of proportional control 26 throughout its range in both directions. A predetermined neutral range 34 is selected by control system 18 that is utilized to indicate that no input is being received from proportional control 26. Proportional control 26 as it is positioned in this range may still be providing a signal but it is a signal that is interpreted as no input. The signal from proportional control 26 is altered when proportional control 26 is rotated in either direction. When proportional control 26 is rotated into forward range 30, control system 18 interprets the position as a desired speed output as well as a forward direction. When proportional control 26 is moved into reverse range 32, control system 18 interprets the positioning of proportional control 26 as a reverse command and the amount or relative position determines the speed that is to be provided to moving member 12.

Figure 5:
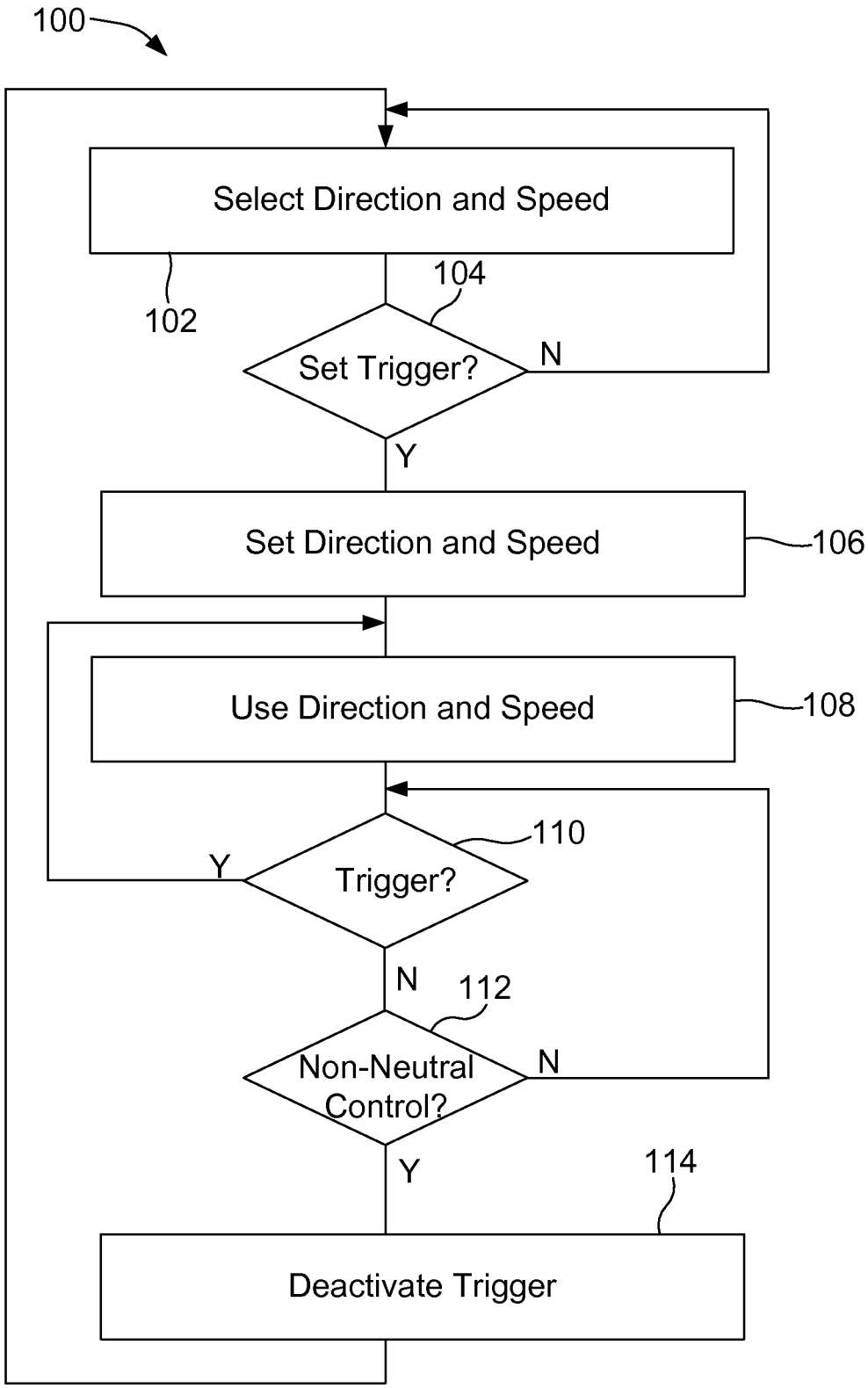
FIG. 5 is a schematic block diagram illustrating a method utilized by the control system of FIGS. 1-4.

Now, additionally referring to FIG. 5 there is shown schematic illustration of method 100 that illustrates an embodiment of the present invention in the interoperation of proportional control 26 and trigger 28 in the control of moving member 12. At step 102 a direction and speed to be applied to moving member 12 is selected by the positioning of proportional control 26. Proportional control 26 is positioned either in forward range 30 or reverse range 32 and the relative positioning of proportional control 26 establishes the speed of motion to be applied to moving member 12. When a desired speed and direction is achieved by moving member 12 trigger 28 is set at step 104 by depressing trigger 28. This sets the direction and speed at step 106 that will then be repeated each time trigger 28 is depressed at step 110 to thereby use the direction and speed at step 108. Alternatively, trigger 28 may act as a toggle in which one depressing of trigger 18 causes moving member 12 to operate at the selected direction and speed with the next depressing of trigger 28 toggling control system 18 to remove all power from moving member 12. Additionally, the positioning of proportional control 26 may, apart from trigger 28, cause the operation of moving member 12 in the direction and speed proportional to the positioning of proportional control 26.

Once trigger 28 is depressed at step 104 to set the direction selected by proportional control 26, the speed of moving member 12 may be selected to be a predetermined speed different than that set by proportional control 26, the predetermined speed may be a maximum speed of moving member 12. The maximum speed being determined by the maximum hydraulic flow provided to auxiliary hydraulic system 16. In this alternate operating method proportional control 26 effectively operates as a direction selecting device only with the speed already determined by control system 18.

Now, additionally referring to FIG. 5 there is shown schematic illustration of method 100 that illustrates an embodiment of the present invention in the interoperation of proportional control 26 and trigger 28 in the control of moving member 12. At step 102 a direction and speed to be applied to moving member 12 is selected by the positioning of proportional control 26. Proportional control 26 is positioned either in forward range 30 or reverse range 32 and the relative positioning of proportional control 26 establishes the speed of motion to be applied to moving member 12. When a desired speed and direction is achieved by moving member 12 trigger 28 is set at step 104 by depressing trigger 28. This sets the direction and speed at step 106 that will then be repeated each time trigger 28 is depressed at step 110 to thereby use the direction and speed at step 108. Alternatively, trigger 28 may act as a toggle in which one depressing of trigger 28 causes moving member 12 to operate at the selected direction and speed with the next depressing of trigger 28 toggling control system 1 to remove all power from moving member 12. Additionally, the position of proportional control 26 may, apart from trigger 28, cause the operation of moving member 12 in the direction and speed proportional to the position of proportional control 26.

Figure 6:
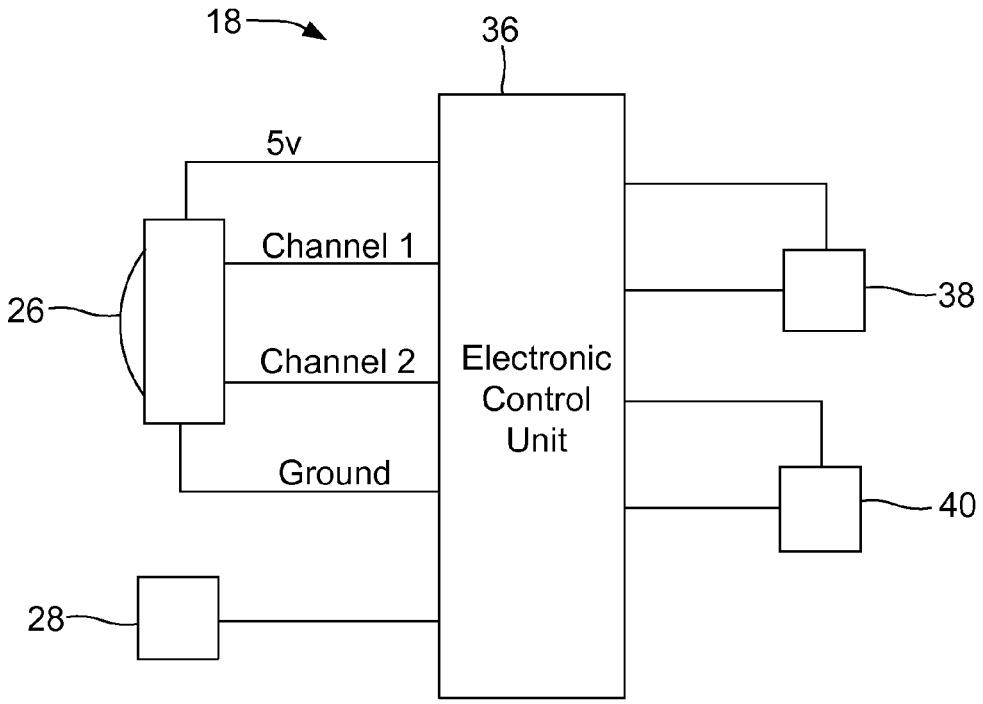
FIG. 6 is a schematical block diagram of the control system that utilizes the method of FIG. 5 and represents the control systems of FIGS. 1-4.

Now, additionally referring to FIG. 6, there is shown a schematical block diagram of control system 18 including control unit 36 and proportional valves 38 and 40. When proportional control 26 is centered in neutral range 34, channel 1 and channel 2 can be thought of as each providing a two and a half volt signal to control unit 36. The selection of the actual voltage levels on channel 1 and channel 2 are arbitrary, but for ease of illustration the levels are understood to be half of the five volt level relative to the ground line. The mathematical total of the voltage on channel 1 and channel 2 are substantially equal to the difference between the five volt and ground line values, which are references for control unit 36, and can be simply thought of as 5 volts. By requiring the total voltage on channels 1 and 2 to be approximately 5 volts electronic control unit 36 can evaluate the validity of the signals received from proportional control 26. For example, if the total voltage on channel 1 and 2 is inside of a predetermined value, which for the sake of discussion will be plus or minus ½ volt the signal is considered valid and it is assumed that no signal line is broken from proportional control 26 to control unit 36. However, if either channel 1 or channel 2 is interrupted or if an additional voltage is supplied thereon, then it is extremely unlikely that the voltage on channel 1 and 2 will be within the plus or minus one half volt window, thereby indicating that the signal from proportional control 26 is invalid and should be ignored by control unit 36. The determination of an invalid signal can cause moving member 12 to stop. As proportional control 26 is moved from neutral position 34 the voltage on channel 1 moves opposite to the voltage on channel 2, which may be accomplished with mechanically linked potentiometers that are wired to respectively increase and decrease the voltage on channels 1 and 2 relative to the position of proportional control 26.

As previously discussed, when the direction and/or speed of moving member 12 has been set at step 106, each time trigger 28 is used to engage moving member 12 or disengage moving member 12 then proportional valves 38 and 40 are appropriately commanded based upon the signal received from trigger 28. For example, proportional valve 38 operates in forward range 30 and is opened to the set position to replicate the flow to auxiliary hydraulic system 16 when trigger 28 is depressed. When trigger 28 is released proportional valve 38 will close. Valve 40 is used in a similar fashion if a reverse direction is selected from reverse range 32. Proportional valves 38 and 40 may be operated to completely open in response to a command if maximum flow is required based on the foregoing discussion of the control of auxiliary hydraulic system 16.

Advantageously the present invention allows an operator to select the direction and the speed, depending upon the implementation, and once selected by a proportional control the auxiliary hydraulic unit can be alternately powered and disengaged by operation of a trigger switch. This allows for repeatability in the motion of a hydraulic unit and even though described as being an auxiliary control the same method can be utilized for hydraulic systems of ground engaging vehicle 10, such as an extendable portion of a backhoe.

Figure 7:
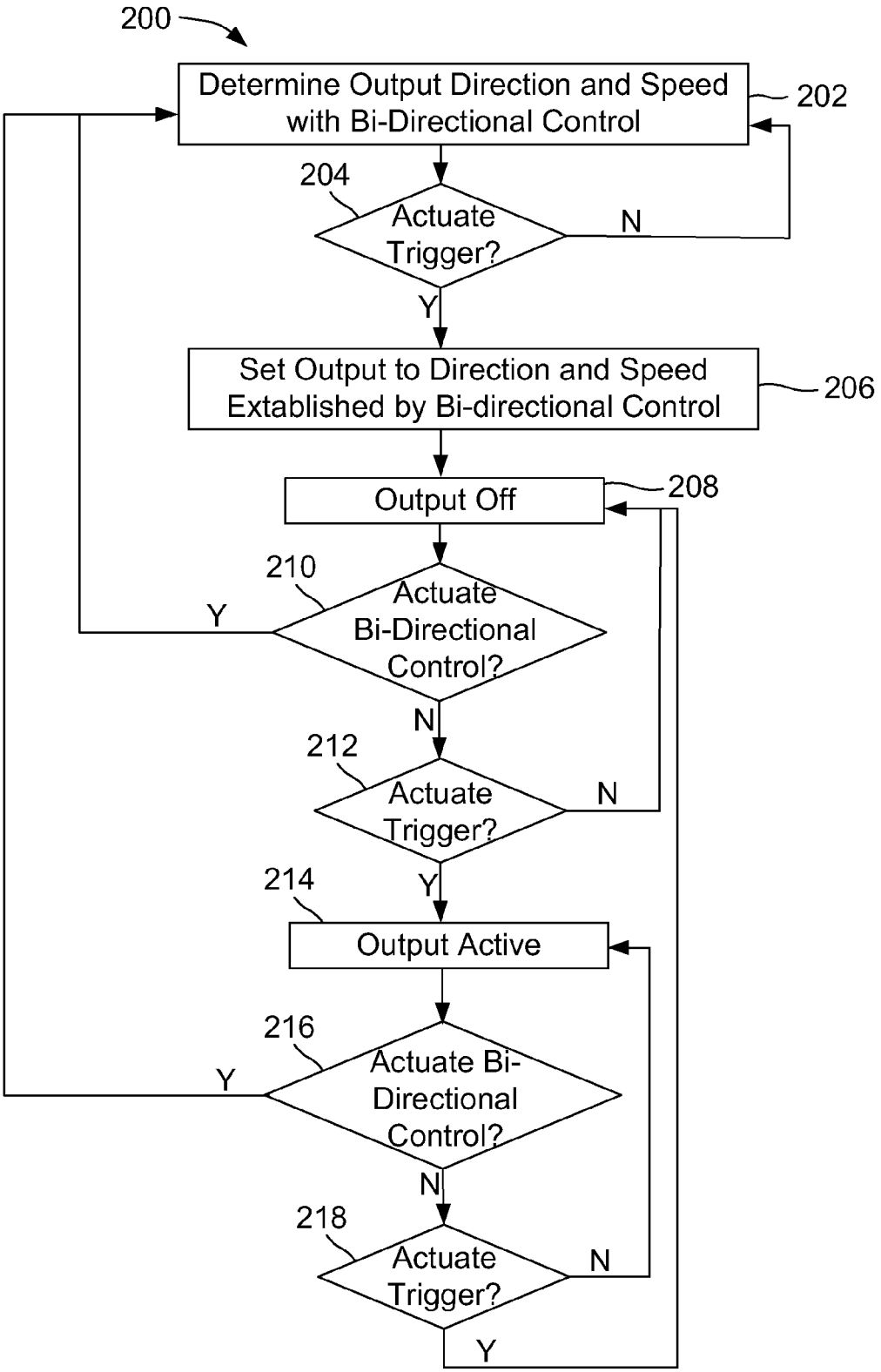
FIG. 7 a schematical block diagram illustrating another method utilized by the control system of FIGS. 1-4.

Now, additionally referring to FIG. 7 there is shown another schematic illustration of a method 200 that illustrates an embodiment of the present invention relative to the operation of proportional control 26, also known as a bi-directional proportional control 26 or simply as a bi-directional control 26, and trigger 28 in the control of moving member 12. At step 202, it is determined what the direction and speed that is being selected by bi-directional control 26 as it is positioned by an operator. Proportional control 26 is positioned either in forward range 30 or reverse range 32 and a relative positioning of proportional control 26 establishes the direction and speed of motion to be applied to moving member 12. When the desired speed and direction is achieved by moving member 12, trigger 28 is depressed at step 204 to set the speed and direction of moving member 12 so that the speed and direction or at least the direction can then be activated by subsequent action of trigger 28.

If trigger 28 is not depressed the method returns to step 202. If trigger 28 has been depressed then at step 206 the output is set to thereby establish the direction and speed set by bi-directional/proportional control 26. At step 208, the output is active and method 200 checks at step 210 to see if there is an additional movement of bi-directional control 26. If there is additional movement then method 200 returns to step 202. If no further positioning of bi-directional control 26 takes place then method 200 proceeds to step 212 to check for the activation of trigger 28. If trigger 28 has not been activated then method 200 returns to step 208. If trigger 28 is activated at step 212 it toggles the output off at step 214 thereby stopping moving member 12. If bi-directional control remains unmoved at step 216 then method 200 again checks for the actuation of trigger 28 at step 218. If trigger 28 is triggered this causes method 200 to go to step 208 again activating moving member 12. In this manner the actuation of trigger 28 toggles moving member 12 between no output and returning to the selected output direction and speed. The toggling aspect continues until bi-directional control 26 is actuated thereby returning method 200 to step 202.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A ground engaging vehicle, comprising:

a tool having a moving member; and a control system configured to control a speed and direction of said moving member, said control system including:

an adjustable proportional control generating a signal corresponding to a direction and speed of said moving member;

a toggle triggering control setting at least one of a set direction and a set speed upon activation during generation of said signal by said proportional control;

wherein, upon a first activation of said triggering control after said at least one set direction and set speed have been set, said control system sends a set command to said moving member corresponding to said at least one set direction and set speed;

wherein, while said moving member is moving under said set command, a subsequent activation of said triggering control causes said control system to send a zero power command to said moving member;

wherein sequentially activating said triggering control causes said control system to alternate between sending to said moving member said set command and said zero power command;

wherein said first activation of said triggering control activates said moving member to move in said set direction at one of said set speed and a predetermined speed; and wherein said proportional control has a neutral position, said proportional control negating said triggering control setting said at least one of said set direction and said set speed when said proportional control is adjusted away from said neutral position after creating said signal.

2. The ground engaging vehicle of claim 1, wherein said predetermined speed is a maximum speed of the moving member.

3. The ground engaging vehicle of claim 2, further comprising a valve under the control of said control system, said maximum speed being determined by said valve being fully opened.

4. The ground engaging vehicle of claim 1, wherein said signal is a two channel electrical signal that is evaluated by said control system to determine if a sum of a voltage level on each of said two channels is within a predetermined value indicating said signal is valid.

5. The ground engaging vehicle of claim 4, wherein said control system is further configured to stop said moving member if said signal is not valid.

6. The ground engaging vehicle of claim 1, wherein said proportional control has a neutral position, said proportional control negating said triggering control setting of said set direction when said proportional control is adjusted away from said neutral position after returning to said neutral position after generating said signal.

7. The ground engaging vehicle of claim 1, wherein the adjustable proportional control and the triggering control are mounted on a single control lever; and wherein the triggering control is a trigger switch mounted to a front of the control lever and the adjustable proportional control is a roller mounted to a top of the control lever.

8. The ground engaging vehicle of claim 1, wherein said trigging control sets both direction and speed of said moving member dependent upon said signal.

9. A control system for controlling a speed of a moving member of a ground engaging vehicle, the control system including:

an adjustable proportional control generating a signal corresponding to a direction and speed of said moving member;

a toggle triggering control setting at least one of a set direction and a set speed upon activation during generation of said signal by said proportional control;

wherein, upon a first activation of said triggering control after said at least one set direction and set speed have been set, said control system sends a set command to said moving member corresponding to said at least one set direction and set speed;

wherein, while said moving member is moving under said set command, a subsequent activation of said triggering control causes said control system to send a zero power command to said moving member;

wherein sequentially activating said triggering control causes said control system to alternate between sending to said moving member said set command and said zero power command;

wherein said first activation of said triggering control activates said moving member to move in said set direction at one of said set speed and a predetermined speed; and wherein said proportional control has a neutral position, said proportional control negating said triggering control setting said at least one of said set direction and said set speed when said proportional control is adjusted away from said neutral position after returning to said neutral position after creating said signal.

10. The control system of claim 9, wherein said predetermined speed is a maximum speed of the moving member.

11. The control system of claim 10, further comprising a valve under the control of said control system, said maximum speed being determined by said valve being fully opened.

12. The control system of claim 9, wherein said signal is a two channel electrical signal that is evaluated by said control system to determine if a sum of a voltage level on each of said two channels is within a predetermined value indicating said signal is valid.

13. The control system of claim 12, wherein the control system is further configured to stop said moving member if said signal is not valid.

14. The control system of claim 9, wherein said proportional control has a neutral position, said proportional control negating said triggering control set of said direction when said proportional control is adjusted away from said neutral position after returning to said neutral position after generating said signal.

* * * * *

UNITED STATES PATENT AND TRADEMARK OFFICE

CERTIFICATE OF CORRECTION

PATENT NO. : 9,037,355 B2
APPLICATION NO. : 11/934855
DATED : May 19, 2015
INVENTOR(S) : Scheer It is certified that error appears in the above-identified patent and that said Letters Patent is hereby corrected as shown below:

In the specification

Column 3, line 36: delete "trigger 18" insert --trigger 28--

Column 3, between lines 53 and 54 insert:

--The direction and speed selected is utilized at step 108 depending on trigger commands of trigger 28 interpreted at step 110. At step 112 control system 18 is checking to see if proportional control 26 has been moved from a neutral position to a non-neutral position. Step 112 is only functional once proportional control 26 is returned to a neutral position after setting the direction and speed in step 102. In step 112 control system 18 determines whether proportional control 26 is moved to a range other than neutral range 34. If proportional control 26 remains in neutral range 34 then method 100 returns to step 110. When proportional control 26 is moved to a position other than neutral range 34, then at step 114 the speed and direction of moving member 12 is no longer controlled by trigger 28. Trigger 28 is effectively deactivated so that it no longer controls the direction and/or speed of moving member 12, until it is again set by the sequence of steps 102, 104 and 106. Method 100 then will reinitiate once proportional control 26 is again returned to neutral range 34 and at that point proportional control 26 controls the direction and speed of moving member 12 by positioning proportional control 26 into forward range 30 or reverse range 32.--

Signed and Sealed this
Sixth Day of October, 2015

Michelle K. Lee

Michelle K. Lee
*Director of the United States Patent and Trademark Office*